United States Patent [19]

Miller et al.

[11] Patent Number: 4,527,577

[45] Date of Patent: Jul. 9, 1985

[54] DEVICE FOR AUTOMATIC CASHIERS FOR STORING COINS

[75] Inventors: Gert Miller; Franz Diers, both of Monchen-Gladbach; Hans-Josef Hermanns, Korschenbroich, all of Fed. Rep. of Germany

[73] Assignee: Scheidt & Bachmann GmbH, Monchen-Gladbach, Fed. Rep. of Germany

[21] Appl. No.: 574,567

[22] Filed: Jan. 27, 1984

[30] Foreign Application Priority Data

Feb. 9, 1983 [DE] Fed. Rep. of Germany ..... 3304336

[51] Int. Cl.[3] ..... G07D 3/00; G07F 5/10

[52] U.S. Cl. ..... 133/3 H; 194/1 F; 232/1 D; 232/43.3

[58] Field of Search ..... 232/1 D, 43.3, 56, 60; 206/0.8; 133/4 R, 4 A, 5 R, 3 H; 235/7 A, 100; 194/1 F

[56] References Cited

U.S. PATENT DOCUMENTS 401,593 4/1889 Roggy ..... 232/64 X
1,204,454 11/1916 Kelley ..... 232/56
2,059,936 11/1936 Engleman ..... 235/100
2,482,258 9/1949 Funk, Jr. et al. ..... 206/0.8

FOREIGN PATENT DOCUMENTS 0000010 12/1978 European Pat. Off. ..... 194/1 F

*Primary Examiner*—Robert P. Swiatek
*Attorney, Agent, or Firm*—Becker & Becker, Inc.

[57] ABSTRACT

A device for automatic cashiers, for example in vending machines, for the sale of goods or for dispensing services, for storing coins. The device has a slot for coins, a subsequently-arranged storage channel, a return slot, and a coin-collecting opening. A spiral spring for receiving respective coins between adjacent turns of the spring is disposed in the storage channel. The spring can be rotated at least one full turn in either direction by a motor. In order structurally to simplify and reduce the space required by such devices, which can be used either as intermediate storage devices or as remaining-money storage devices, the storage channel is constructed as a lateral guide for the spiral spring, and the return slot is offset relative to the money slot by at least one pitch of the spiral spring. The money slot is disposed on one side of the storage channel, and the return slot is disposed on the other side thereof.

6 Claims, 2 Drawing Figures

DEVICE FOR AUTOMATIC CASHIERS FOR STORING COINS

BACKGROUND OF THE INVENTION

The present invention relates to a device for automatic cashiers, e.g. in vending machines, for the sale of goods or the dispensing of services, for storing or accumulating coins. The device has a coin slot, a subsequently arranged storage channel, a return slot, and a coin-collecting opening. Disposed in the storage channel is a spiral spring for receiving respective coins between adjacent turns of the springs. The spiral spring can be rotated at least one full turn in either direction by a motor.

Devices of the aforementioned general type exist both as so-called intermediate storage means for coins of different values, with a subsequently arranged coin sorting device, and also as so-called leftover-coin storage means of coins having the same value. During the course of a purchase, all the coins deposted therefore are stored in the intermediate storage means so that these same coins can again be returned if the purchase is interrupted, for example because an insufficient amount of coins were inserted, or if the user of the vending machine presses the coin return because he made a mistake in his selection of goods or services. In this case, the coins of different value which are present in the storage channel are returned to the user via a return slot. This procedure precludes the user from exchanging counterfeit coins, which have somehow passed by the coin checker, for genuine coins from the machine. During a normal purchase procedure, the coins which are temporarily stored in the storage channel of the temporary storage means are fed to a subsequently arranged coin-sorting device, so that the coins in conformity with their value subsequently can be supplied to the actual storage means of the automatic cashier or into the end cash-box.

The leftover-money storage means of a vending machine for the sale of goods or the dispensing of services respectively contain coins of the same value, since they are intended for having available the necessary amount of money for machines which make change. Such remaining-money storage means are normally arranged within the machine after the coin-sorting device, so that they not only give change from the money contained therein, but can also be refilled with coins inserted into the machine when purchases are made.

The known devices for storing coins, which devices are provided with a storage channel which is connected after a coin slot, have the drawback that on the one hand they have a relatively complicated and expensive construction, and on the other hand they require a relatively large amount of space.

It is therefore an object of the present invention to provide a storage device of the aforementioned general type for coins which is structurally simpler and requires less space.

BRIEF DESCRIPTION OF THE DRAWINGS

This object, and other objects and advantages of the present invention, will appear more clearly from the following specification in conjunction with the accompanying drawings, in which.

SUMMARY OF THE INVENTION

Figure 1:
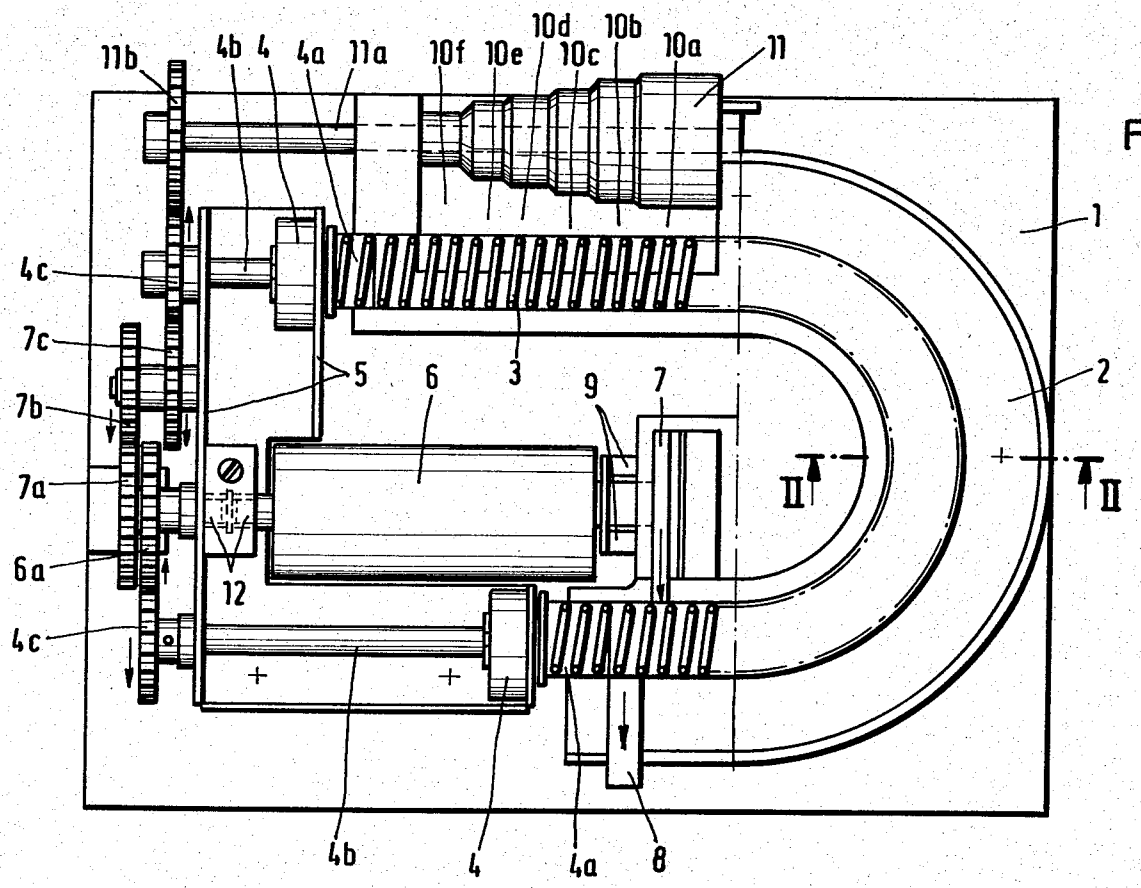
FIG. 1 is a plan view of one inventive embodiment of a storage device.

The storage device of the present invention is characterized primarily in that the storage channel is constructed as a lateral guide for the spiral spring, and in that the return slot is offset relative to the coin slot by at least one pitch of the spiral spring, with the coin slot being disposed on one side of the storage channel, and the return slot being disposed on another side thereof.

The proposal pursuant to the present invention provides not only for intermediate storage means but also for remaining-money storage means representing a construction which is space saving and comprises simple and hence economical components. The spiral spring, which can be used, for example, in place of expensive worm-gears or endless screws, is not only considerably more economical, but also makes possible the storage of a far greater number of coins within the same amount of space. In so doing, not only coins of the same value but also coins of different values can be stored between the individual turns of the spiral spring. Depending upon the direction of rotation of this spring, the coins located between the turns of the spring can be stored or they can be returned via the return slot. The storage channel which accommodates the spiral spring is inventively at the same time constructed as the lateral guide for the spring, so that there can be dispensed with any additional guide elements for the spiral spring.

Pursuant to a preferred embodiment of the present invention, the storage channel has a V-shaped cross section, with a linear leg which exceeds the diameter of the spiral spring, and with a curved leg which adjoins the linear leg via a rounded-off portion which conforms to the curvature of the turns of the spring; the curved leg encloses the spiral spring along an arc of more than 90°. By means of the use of the linear leg which exceeds the diameter of the spiral spring, coins of different diameters can be stored in the storage channel. The curved leg which encloses the spiral spring along an arc of more than 90° ensures that the spiral spring does not move out of the storage channel at an angle thereto.

A significant advantage of the inventive use of a spiral spring consists in that pursuant to further features of the present invention, the storage channel and the spiral spring can extend in a curved fashion with at least one curvature, with the spiral spring being synchronously driven at both ends. In this way, it is possible to deviate from a linear path of the storage channel, and hence of the spiral spring, and to construct these, when viewed in plan, as U-shaped, S-shaped, circular, or in any other desired manner with one or more curvatures. In this way, the space required for the inventive storage device is considerably reduced.

With a U-shaped construction of the storage channel and the spiral spring, the advantage is obtained pursuant to a further feature of the present invention so that both ends of the spiral spring can be driven via pinions and intermediate gears of the drive gear of a common motor, so that also to this extent considerable structural simplfication results.

If the inventive storage device is embodied as an intermediate storage means for coins having different value, it is proposed pursuant to the present invention to arrange a mechanical sorting device at the end of the storage channel. This sorting device inventively can be provided with graduated sorting openings which conform to the diameters of the coins, and which are formed by a graduated, rotatably mounted cylinder.

If, pursuant to a further feature of the present invention, this cylinder which forms the sorting openings of the sorting device can be driven in a given direction, then even those coins which are located in the region of the sorting openings can be returned to the storage channel itself by rotating the spiral spring in the return direction, since this inventive rotation of the cylinder provides the possibility for returning coins to the sorting channel, in particular, coins located in the region of the sorting openings, despite the presence of graduated sorting openings.

Taken as a whole, the present invention provides a storage device which, despite its simple and hence economically producible construction and its low space requirement, has a high operating reliability and can be used not only as an intermediate storage means for coins of different value, but also as a remaining-money storage means for coins of the same value.

DESCRIPTION OF PREFERRED EMBODIMENTS

Figure 2:
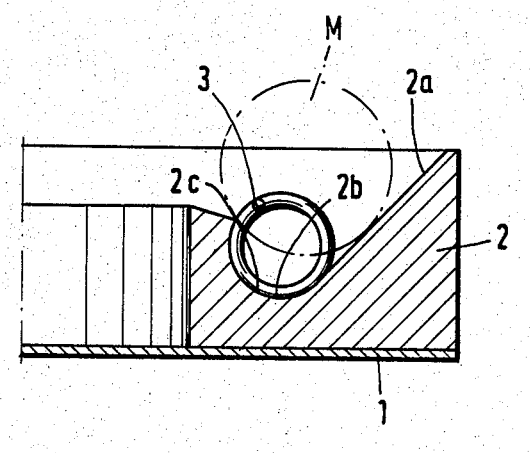
FIG. 2 is a cross section taken along the line II—II in FIG. 1.

Referring now to the drawings in detail, the embodiment illustrated therein is designed as a temporary storage means for installations in automatic cashiers, for instance in vending machines, for the sale of goods or for the dispensing of services. This inventive device includes a base plate 1 having a storage channel 2, which is substantially U-shaped, arranged thereon. As shown in FIG. 2, the storage channel 2, which can be made of plastic or light metal, has an essentially V-shaped receiving cross section for coins that are to be stored, with one such coin M being illustrated by a dot dash line in FIG. 2.

Disposed in the storage channel 2, there is a spiral spring 3 for receiving a single coin M between adjacent turns of the spring. The spiral spring 3 can be clearly seen in the cross section of FIG. 2 and the plan view of FIG. 1, with the central portion of the spring 3 being omitted from the plan view to simplify the drawing.

Each end of the spiral spring 3 is attached to a cylindrical extension 4*a* of a respective drive wheel 4. Each drive wheel 4 is seated on a respective drive shaft 4*b* which is rotatably mounted in a bearing support 5 mounted on the base plate 1. A respective pinion 4*c* is mounted on each of the drive shafts 4*b*. Whereas one of the pinions 4*c* meshes directly with a drive gear 6*a* of a motor 6, the other pinion 4*c* is connected via three intermediate gears 7*a*, 7*b*, and 7*c* of a reversing gearing with respect to the drive gear 6*a* of the motor 6 in such a way that the spiral spring 3 is driven accordingly via the extensions 4*a* of the drive wheels 4 at both ends thereof synchronously, respectively, in an equivalent sense of rotation.

The spiral spring 3, which in the illustrative embodiment is provided for the temporary storage of coins of different value, is rotatably guided in the storage channel 2. For this purpose, the storage channel 2 has its essentially V-shaped cross section, the linear leg 2*a* of which has a length which exceeds the diameter of the spring 3, so that as shown in FIG. 2, coins M having a larger diameter can also be stored and guided in the channel 2. A curved leg 2*c* adjoins the linear leg 2*a* via a rounded-off portion 2*b*, the curvature of which conforms to the curvature of the turns of the spring; as shown in FIG 2, the leg 2*c* encircles more than a 90° arc of the spiral spring 3. Consequently, the rotating spring 3 is guided in the storage channel 2 in such a way that it cannot lift out of the channel 2 at an angle relative to its direction of rotation.

The coins to be stored are fed to the spiral spring 3 located in the storage channel 2, respectively, one at a time through a coin slot 7, which in the illustrated embodiment, as shown in FIG. 1, is located on the inner side of the spiral spring 3. On the outer side of the spring 3 there is provided a return slot 8 which is offset relative to the slot 7 by one pitch of the spiral spring 3, and in particular being offset in the direction toward the end of the spring 3.

Upon entering the slot 7, a coin is fed through this slot to that turn of the spiral spring 3 which is located opposite the slot 6 at that time. At least one sensor 9 is arranged in the vicinity of the slot 7 in order to detect the coin which enters the slot 7. This sensor 9 activates the motor 6 in order to rotate the spiral spring 3 by one full turn. In so doing, the coin which has entered the spiral spring 3 is transported in the storage channel 2 in the direction of rotation by one pitch of the spiral spring 3, so that a free turn of the spring 3 is opposite the slot 7 for receiving a further coin. In this manner, any number of coins of different values can be stored in the channel 2.

If a user decides, for example, to interrupt his purchase, and wishes the return of the temporarily stored coins, the spiral spring 3 is driven in the opposite direction of rotation by the motor 6. In so doing, the coins located in the turns of the spring 3 successively reach the region of the return slot 8, with the aid of which they can be returned to the user, and in particular in an order opposite to that in which they were inserted. By appropriate control of the motor 6, with monitoring by a sensor 12, care is taken hereby that only those coins, which were actually inserted initially, are returned via the return slot 8 by reverse rotation of the spring 3.

In order to be able to feed the coins located in the storage channel 2 to subsequent storage means or the end cashbox in conformity with their respective values, a coin sorting device is arranged at the end of the channel 2. In the illustrated embodiment, this is a mechanical sorting device which is provided with sorting openings 10*a* to 10*f* which are graduated in conformity with the diameters of the coins and the opening widths of which increase in the direction toward that end of the storage channel 2 which is remote from the slot 7. The opening widths of these sorting openings 10*a* to 10*f* correspond, for example, to the diameter of nickles, dimes, quarters, and half dollars.

In the illustrated embodiment, these sorting openings 10*a* to 10*f* formed by a graduated cylinder 11 which is rotatably mounted on a shaft 11*a*. By means of a pinion 11*b* mounted on the shaft 11*a*, the cylinder 11 is driven by the motor 6 in conformity with the rotation of the spiral spring 3. In so doing, in conjunction with bevelled portions between the individual gradations of the cylinder, even coins located in the region of the sorting openings 10*a* to 10*f* can be transported within the storage channel 2 in the direction toward the return slot 8 without jamming on the graduations of the cylinder 11.

As the embodiment of FIG. 1 illustrates, it is readily possible to provide the storage channel 2 and the spiral spring 3 disposed therein with a curved shape, and even with one or more curves. In place of the semicircular curvature of the illustrated embodiment, the storage channel 2 and the spiral spring 3 also can be S-shaped or circular, or can have one or more curves in any other desired configuration, so that the storage channel 2 can be given any desired shape optimally adapted to the individual situation, with the only note of caution being to not fall below certain radii of curvature for the storage channel 2 and the spiral spring 3.

The present invention is, of course, in no way restricted to the specific disclosure of the specification and drawings, but also encompasses any modifications within the scope of the appended claims.

What we claim is:

1. A device for automatic cashiers of, for example, vending machines, for storing coins; said device comprises:

a coin slot;

a storage channel which communicates with said coin slot;

a coin return slot which communicates with said storage channel; said coin slot and said return slot essentially being disposed on opposite sides of said storage channel;

means in communication with said storage channel for collecting coins therefrom;

a spiral spring disposed in said storage channel and having spring turns of receiving between adjacent ones thereof a single coin; said storage channel being constructed as a lateral guide for said spiral spring; said return slot being offset relative to said coin slot by at least one pitch of said spiral spring;

a motor for turning said spiral spring at least one full turn in either direction; and said storage channel having a V-shaped cross section, including a linear first leg which exceeds the diameter of said spiral spring, a curved second leg which conforms to the curvature of said turns of said spiral spring, and a rounded-off portion by means of which said first and second legs are connected to one another; and also said curved second leg encloses said spiral spring over an arc of greater than 90°.

2. A device according to claim 1, in which said storage channel and said spiral spring are curved, each having at least one curvature; and in which said spiral spring has two synchronously rotated ends.

3. A device according to claim 2, in which said motor includes a drive gear; and which includes pinions and intermediate gears associated with the ends of said spiral spring and said drive gear and rotatable via the latter.

4. A device according to claim 2, in which said means for collecting coins from said storage channel is a mechanical sorting device disposed at an end thereof.

5. A device according to claim 4, in which said sorting device is a graduated, rotatably mounted cylinder which is provided with sorting openings graduated in conformity with the diameters of coins.

6. The device according to claim 5, in which said cylinder can be rotated for return of coins.

* * * * *